US009199833B2

(12) United States Patent
Scarvelli

(10) Patent No.: US 9,199,833 B2
(45) Date of Patent: Dec. 1, 2015

(54) SELF SERVICE CONTROLLED BEVERAGE DISPENSING SYSTEM

(71) Applicant: Mistee Scarvelli, Kissimmee, FL (US)

(72) Inventor: Mistee Scarvelli, Kissimmee, FL (US)

( * ) Notice: Subject to any disclaimer, the term of this patent is extended or adjusted under 35 U.S.C. 154(b) by 475 days.

(21) Appl. No.: 13/657,391

(22) Filed: Oct. 22, 2012

(65) Prior Publication Data

US 2014/0110018 A1 Apr. 24, 2014

(51) Int. Cl.

| | |
|---|---|
| ***B65B 31/00*** | (2006.01) |
| ***B67D 1/00*** | (2006.01) |
| ***B67D 3/00*** | (2006.01) |
| *B67D 1/04* | (2006.01) |
| *B67D 1/08* | (2006.01) |

(52) U.S. Cl.

CPC ..... *B67D 1/0004* (2013.01); *B67D 1/0891* (2013.01); *B67D 3/0032* (2013.01); *B67D 3/0083* (2013.01); *B67D 1/0406* (2013.01); *B67D 1/0805* (2013.01); *B67D 1/0807* (2013.01); *B67D 1/0888* (2013.01); *B67D 3/0061* (2013.01); *B67D 2001/0814* (2013.01); *B67D 2001/0817* (2013.01); *B67D 2001/0822* (2013.01); *B67D 2210/00083* (2013.01)

(58) Field of Classification Search

CPC ..... B67D 2210/00083; B67D 2001/0822; B67D 1/0004; B67D 1/0891; B67D 3/0032; B67D 3/0083; B67D 2001/0814; B67D 1/0807; B67D 1/0805; B67D 2001/0817; B67D 1/0406; B67D 3/0061; B67D 1/0888

USPC ..... 141/59, 64, 302, 348, 351, 375; 222/394, 399, 146.1; 235/381; 99/275

See application file for complete search history.

(56) References Cited

U.S. PATENT DOCUMENTS

| | | | | |
|---|---|---|---|---|
| 5,007,560 | A | 4/1991 | Sassak | |
| 5,199,609 | A * | 4/1993 | Ash, Jr. | 222/94 |
| 5,291,004 | A * | 3/1994 | Frank et al. | 235/381 |
| 5,303,845 | A * | 4/1994 | Osawa | 222/1 |
| 5,564,602 | A | 10/1996 | Cleland et al. | |
| 6,349,853 | B1 * | 2/2002 | Grampassi | 222/144.5 |
| 7,757,908 | B1 * | 7/2010 | Buhl, Jr. | 222/608 |
| 2010/0252585 | A1 * | 10/2010 | Yui | 222/400.7 |
| 2011/0017345 | A1 * | 1/2011 | Monzel | 141/1 |
| 2013/0221029 | A1 * | 8/2013 | Vandekerckhove et al. | 222/95 |
| 2014/0079856 | A1 * | 3/2014 | Hatherell | 426/477 |

* cited by examiner

*Primary Examiner* — Jason K Niesz

(74) *Attorney, Agent, or Firm* — Jason T. Daniel, Esq.; Daniel Law Offices, P.A.

(57) ABSTRACT

A self service controlled beverage dispensing system that includes a self-service container filling station, a reusable beverage container, and a dispensing tap. The self service station including a communication unit and a biometric identity unit capable of confirming the identity and age of a user.

9 Claims, 8 Drawing Sheets

SELF SERVICE CONTROLLED BEVERAGE DISPENSING SYSTEM

TECHNICAL FIELD

The present invention relates generally to a beverage dispensing system, and more particularly to a self service system for dispensing high volumes of alcoholic beverages utilizing a reusable container device.

BACKGROUND

The statements in this section merely provide background information related to the present disclosure and may not constitute prior art.

Each year, landfills across the globe are saturated with waste resulting from spent beverage containers. Of particular note are used cans and bottles that once contained beer. This is because, unlike soda and water, for example, many consumers can only obtain beer in individual containers as represented by bottles and/or cans.

There are known methods for dispensing large volumes of beverages such as soda fountains, and professional grade draft beer equipment, these systems are not practical for home use by the average consumer owing to the expense, space requirements and complexity of operation. With particular regard to draft beer systems, there are home kegerator systems which allow kegs of beer to be purchased from a store, and then enjoyed at home.

Unfortunately, however, the entire keg industry suffers from several drawbacks. For example, many retailers who sell cases of beer do not offer beer kegs. This is because beer kegs are typically rented, thus requiring a deposit from the customer at the time of pickup, and a refund of the deposit at the time of return. The returned beer keg must then be thoroughly cleaned, individually filled, and stored on-premises until re-rented by another customer. Once filled, the beer keg must be stored within a particular temperature range, and for a specified time period or else the beer within will become spoiled. To this end, many large retailers do not feel that the potential profits of offering such a service justify the costs in terms of employee time and potential for spoiled product.

Accordingly, it would be beneficial to provide a self service system for dispensing high volumes of alcoholic beverages utilizing a reusable container device that does not suffer from the above noted deficiencies, and acts to reduce landfill waste products.

SUMMARY OF THE INVENTION

The present invention is directed to a self service controlled beverage dispensing system. One embodiment of the present invention can include a self-service container filling station for receiving and filling a reusable beverage container, and a dispensing tap for dispensing the received beverage from the container to a consumer. The self service station can interface with a remote server via a network to confirm the identity and age of a user, and can function to dispense a plurality of temperature controlled beverages into the container.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
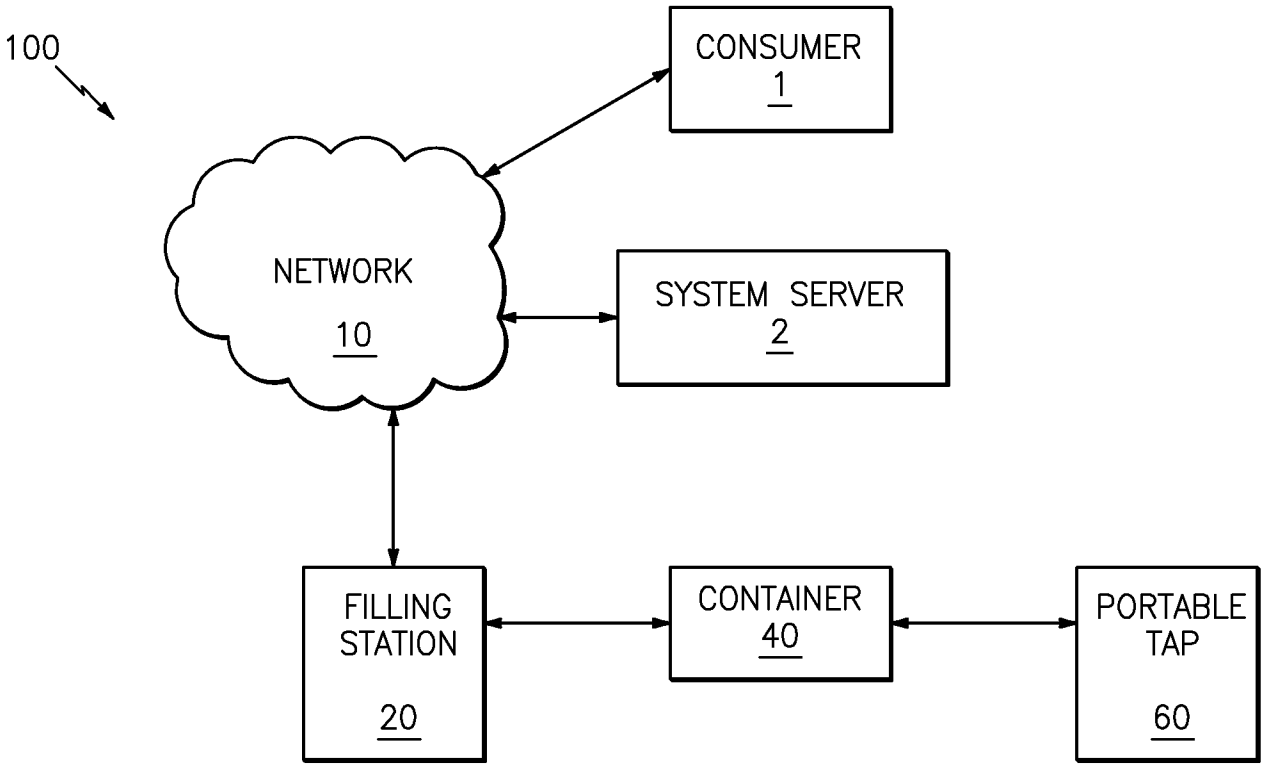
FIG. 1 is a basic block diagram of a self service controlled beverage dispensing system that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Although described throughout this document as a system for dispensing beer, one of skill in the art will recognize that the inventive concepts disclosed herein can be applied to a system for dispensing any number of beverages such as juice, soda and the like, in addition to controlled beverages such as beer and liquor, for example. Accordingly, the system and individual devices are not to be construed as limited to the beer industry.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the dispensing station, the reusable container and the dispenser tap as oriented in FIGS. 2, 5 and 6, respectively.

FIG. 1 illustrates one embodiment of a self service controlled beverage dispensing system that is useful for understanding the inventive concepts disclosed herein. As shown, the system 100 can include a self-service container filling station 20 having a network connection 10, a reusable beverage container 40 and a dispensing tap 60. As will be described below in detail, the dispensing system 100 can act to provide a self service filling station at a merchant location which can dispense controlled beverages such as beer, for example, into a reusable container belonging to an age and identity confirmed consumer. Once filled, the container can be inserted into a portable dispensing tap for consumption by the consumer.

Figure 2:
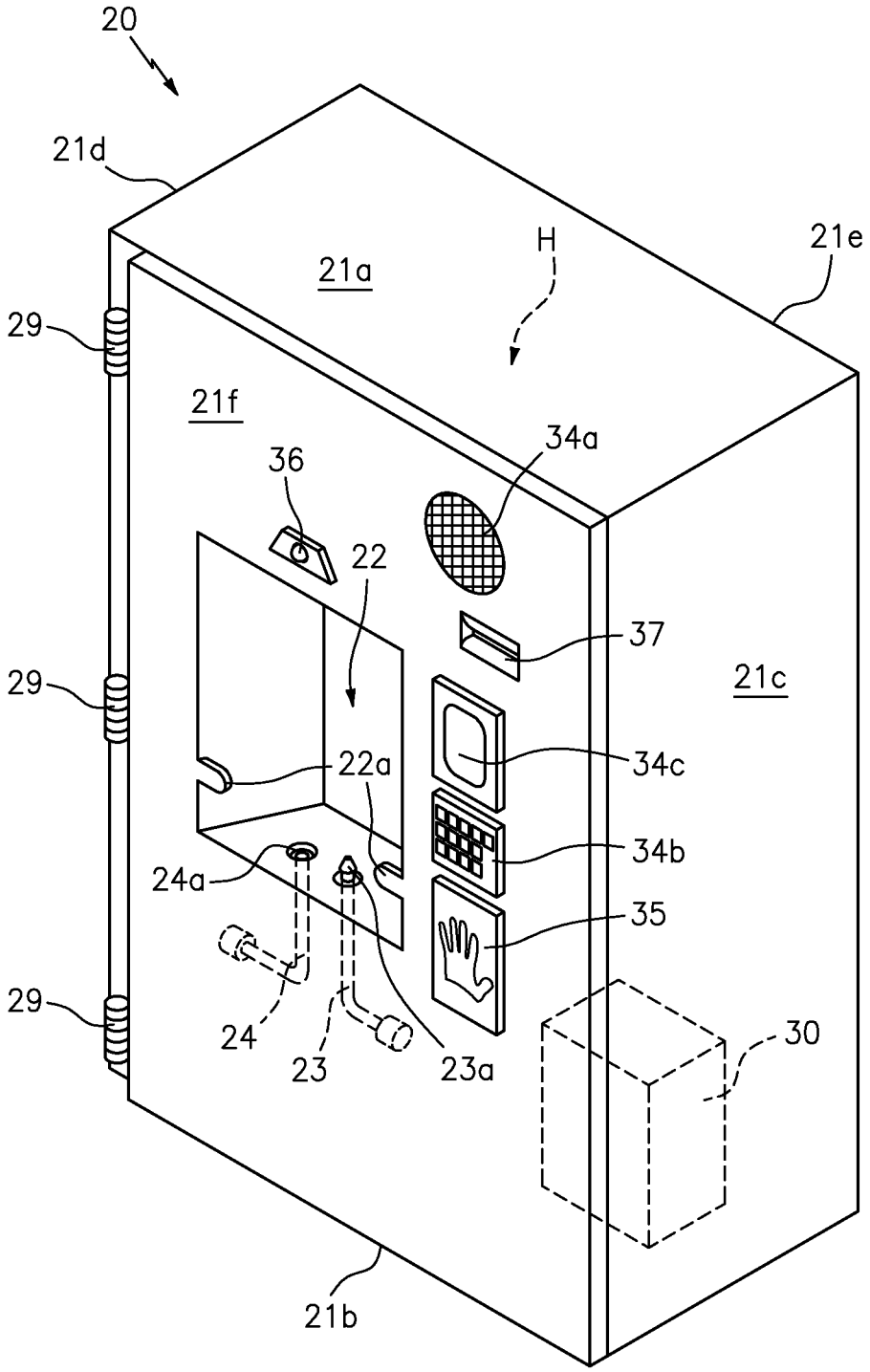
FIG. 2 is a front view of a self-service container filling station, in accordance with one embodiment of the invention.

FIG. 2 illustrates one embodiment of a self service container filling station 20. As shown, the station can include a main body having a container receiving bay 22, a fill line 23, a drain line 24, and a central control unit 30.

In one embodiment the main body can include a top wall 21*a*, a bottom wall 21*b* a pair of opposing side walls 21*c* and 21*d*, a back wall 21*e*, and a front wall 21*f*, each forming an interior space H into which system components can be located. In one optional embodiment, the front wall 21*f* can be hingedly 29 secured to the side walls in order to allow access to the interior space, in accordance with known construction techniques.

In one preferred embodiment, the container filling station 20 can include a solid steel and/or aluminum construction having an outside dimension of approximately 6'×4'×2' (H×L×D), and will further include mounting hardware such as screws, bolts and lag nuts, for example, in order to allow the filling station 20 to be permanently secured to a fixed location. Although not illustrated, optional tamper switches can further be included to alert store personnel when someone attempts to gain unapproved access to the dispensing unit. Such a feature can act as a protective mechanism for preventing the dispensing unit from being moved, stolen or vandalized.

Although described above as including specific dimensions shapes and materials, this is for illustrative purposes only, as one of skill in the art will recognize that the container filling station 20 can include any number of different shapes, sizes and materials, depending on the intended use and/or industry to which the dispensing unit will be used. Additionally, the filling station can include any number of markings and signage, as is customarily found on vending machines, for example.

Figure 5:
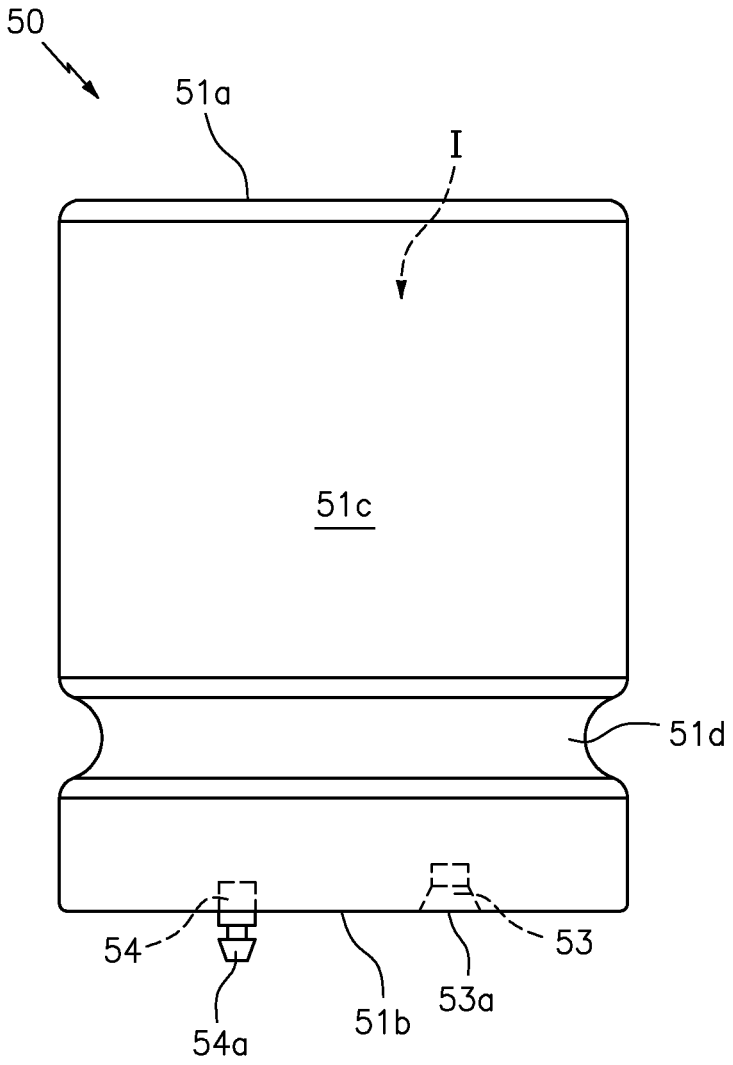
FIG. 5 is a front view of a reusable container, in accordance with another embodiment of the invention.

The receiving bay 22 can act to receive a removable and reusable container 50 (See FIG. 5). To this end, the receiving bay can include a shape that is complementary to the specific shape of the container 50, and can also include one or more protrusions 22*a*, for example, in order to prevent the filling station from operating with devices other than the specified container 50.

A fill line 23 and a drain line 24 can be located within the receiving bay 22 so as to work in conjunction with the fill valve 53 and drain valve 54 of the container 50. To this end, the fill line 23 can include a first end having a connector 23*a* for mating with a complementary connector 53*a* of the container 50 in order to supply a beverage to the container. The drain line 24 can also include a first end having a connector 24*a* for mating with a complementary connector 54*a* of the container 50, in order to remove air and foam from the container.

Each of the fill line 23 and drain line 24 can preferably include an elongated hose that is routed through the rear of the filling station 20 and connected to the supply line and drain line of a conventional beer keg supply system. Such a system can preferably be positioned near the filling station, and in a location that is not accessible to consumers in order to supply climate controlled fresh beer to the filling station 20 on demand.

Conventional beer keg supply systems are extremely well known in the art and include U.S. Pat. No. 5,564,602, to Cleland, and U.S. Pat. No. 5,007,560, for example, the contents of each of which are incorporated herein by reference. To this end, it is noted that the dispensing station 20 can simply take the place of a tap.

In one preferred embodiment, the container filling station 20 can include a biometric identification unit 35, configured to positively establish the age and identity of a person attempting to access the device. Additionally, a camera 36 can also act to record the transaction to further provide assurances against operation by minors.

As described herein, the biometric identification unit 35 can include any number of commercially available devices capable of positively identifying a user based on a unique physical characteristic. Examples of suitable biometric identification units include, but are not limited to, commercially available fingerprint, handprint, and retinal and facial recognition systems, among many others. Moreover, the camera 36 can include any type of optical image capture system including but not limited to a lens based camera, CMOS or CCD camera, as well as a video or still cameras. Each of these devices is well known in the art.

The central control unit 30 can be positioned within the interior space of the main body H and can act to control the various functions of the container filling station 20. In one embodiment, the control unit 30 can function as a gatekeeper for controlling the flow of beer from the conventional supply system to the filling station 20 via the fill line 23 upon verifying the identity of the user.

Figure 3:
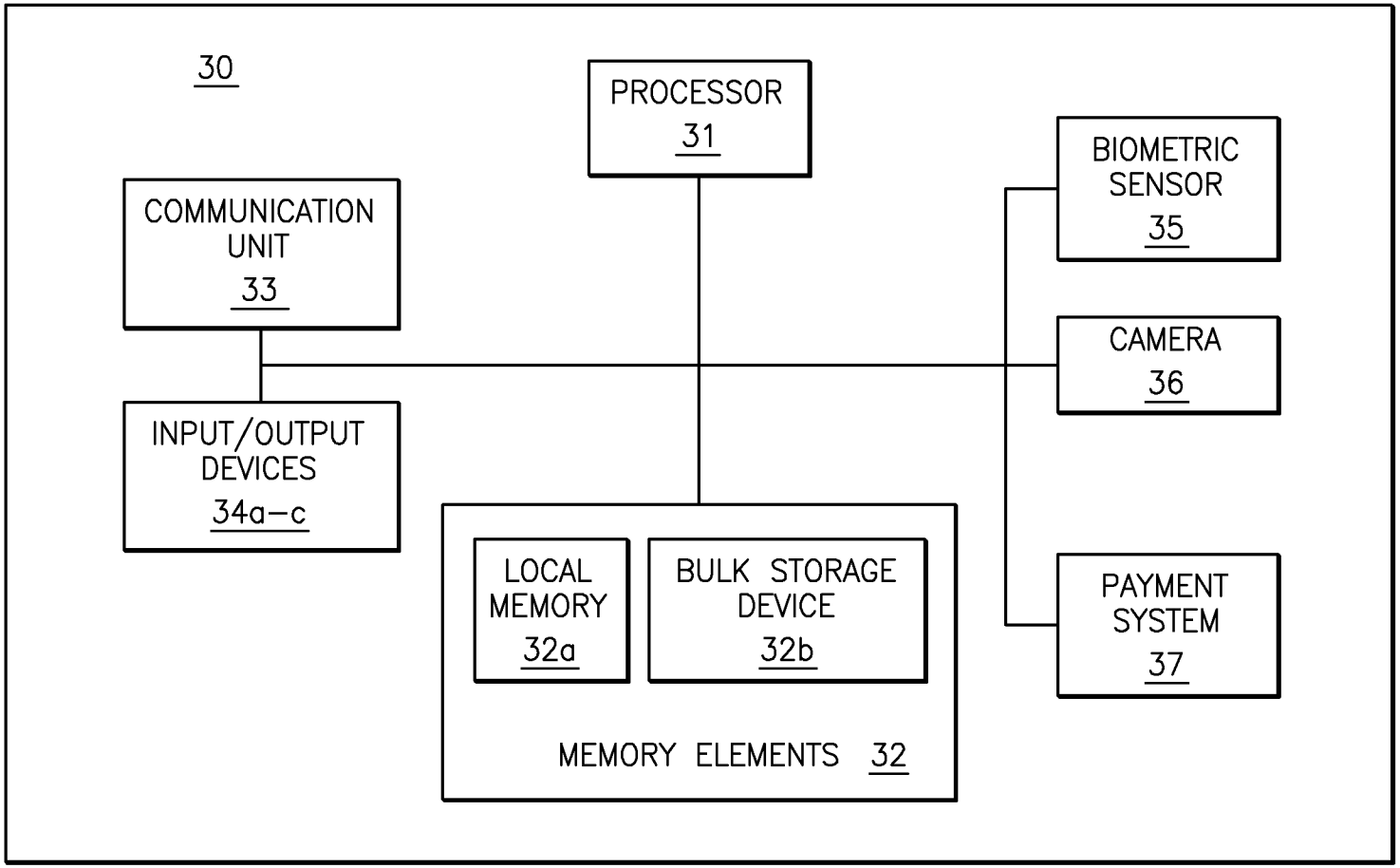
FIG. 3 is an exemplary block diagram of a control unit of the self-service container filling station, in accordance with another embodiment of the invention.

FIG. 3 illustrates a block diagram of an exemplary embodiment of a central control unit 30 that includes a processor 31 being conventionally connected to an internal memory 32, a communications unit 33, a plurality of input/output devices 34, the biometric sensor 35, the camera 36, and a payment reader 37.

The processor 31 can act to execute program code stored in the memory 32 in order to allow the dispensing unit to perform the functionality described herein. Processors are extremely well known in the art, therefore no further description will be provided.

Memory 32 can act to store operating instructions in the form of program code for the processor 31 to execute. As shown in FIG. 3, memory 32 can include one or more physical memory devices such as, for example, local memory 32*a* and/or one or more bulk storage devices 32*b*. As used herein, local memory can refer to random access memory or other such memory device(s) generally used during actual execution of program code, whereas a bulk storage device can be implemented as a persistent data storage device. Additionally, memory 32 can also include one or more cache memories that provide temporary storage of at least some program code in order to reduce the number of times program code must be retrieved from the bulk storage device during execution. Each of these devices is well known in the art.

The communication unit 33 can act to allow the central control unit 30 to communicate with one or more external devices directly, or via a network 10. As described herein, the communication unit can include any number of known devices such as Universal Serial Port (USB), and/or a transmitter and receiver configured to send and receive wired and/or wireless communications (i.e. radio frequency, infrared, Bluetooth, microwave, etc.), as well as network adapters (i.e., Modems, cable modems, Ethernet cards, WAN and LAN adapters). To this end, the communication unit can provide two way communications with other devices such as computer systems, remote printers, and/or remote storage devices through intervening private or public networks.

In one embodiment, the communication unit 33 can communicate with the conventional beer keg supply system to manage a flow of supplied beverage. Additionally, the communication unit can communicate with a system server 2 or other such device in order to confirm that a consumer 1 whose identity has been confirmed via the biometric sensor 35 has registered to use the system.

One or more input/output devices can also be located along the main body of the filling station. Several examples of suitable I/O devices which are illustrated in FIG. 2 include a speaker 34*a*, one or more push buttons/keypads 34*b*, and a display 34*c*.

In one preferred embodiment, the display 34*c* can include a Graphic User Interface (GUI) capable of providing two way communications with a user and the processor 31. To this end, GUI screen 34*c* can preferably include a color touch screen monitor for providing a menu of beverage choices and amounts to be dispensed by the filling station 20.

A payment device such as a credit card reader 37, for example, can also be included so as to receive payments from a user. Payments can be processed in a traditional manner utilizing the communications unit 33.

Figure 4:
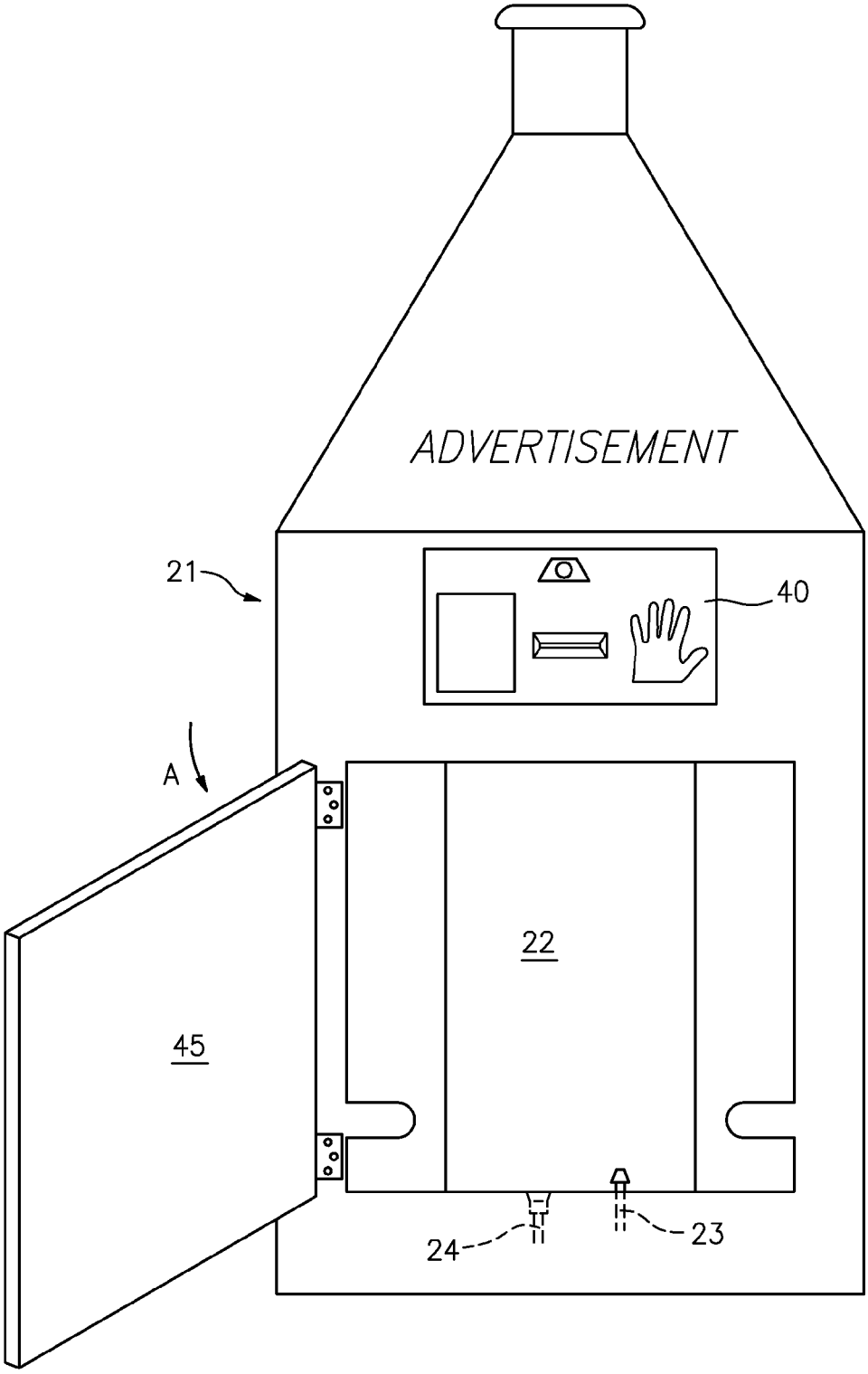
FIG. 4 is a front view of a self-service container filling station, in accordance with another embodiment of the invention.

Although described above as separate individual elements, one of skill in the art will recognize that one or more elements of the central control unit can be combined to form a singular component. To this end, FIG. 4 illustrates an alternate embodiment of the container filling station 20 that includes an integrated identification and control unit 40, and a spray shield 45. As shown, the integrated central control unit 40 can combine the functionality of the central controller 30, the GUI screen 34*c*, one or more of the I/O devices 34, the verification unit 35, the camera 36, and the payment system 37 into a single compact device. Additionally, the main body of the station 20 can include a decorative shape suitable for promoting the type of beverage to be dispensed. In one preferred embodiment, the integrated controller 40 can comprise a tablet pc, for example, running a commercially available operating system configured to perform the various functionality described above.

The spray shield 45 can preferably include a clear plastic design capable of protecting a consumer from spillage in the unlikely event of a machine failure during filling. To this end, the shield 45 can preferably be secured to the main body via one or more hinges 29 so as cover the receiving bay 22, as shown by arrow a. Although not illustrated, the filling station 20 can also include the ability to clean the removable container 50 via a spray solution which can be dispensed through the fill line.

FIG. 5 illustrates one embodiment of a container 50 for use with the container filling station 20 described above. A shown, the container can include an elongated generally tubular main body having a top surface 51*a*, a bottom surface 51*b*, and a generally curved side surface 51*c* forming a hollow interior space I for receiving a beverage. As shown, a pair of indentations 51*d* can be located along the bottom periphery of the side surface 51*c* so as to be compatible with the protrusions 22*a* of the receiving bay of the filling station 20.

A pair of oppositely oriented one way valves 53 and 54 can be located along the bottom surface 51*b*, so as to allow the device to be filled with a beverage and to remove any air or foam which could be contained therein. To this end, fill valve 53 can act as an input for receiving beverages into the interior space I of the container, and can include a connector 53*a* for mating with the complementary connector 23*a* of the fill line 23 of the filling station 20. Likewise, valve 54 can act as an output for removing air and foam from the interior space I of the container, and can include a connector 54*a* for mating with the complementary connector 24*a* of the drain line 24 of the filling station 20, and supply the same to the drain line 24. The output valve 54 can further include a protruding end 54*a* for mating with the opening 24*a* of the drain line 24.

In one preferred embodiment, the container 50 can be constructed from a single mold of injected plastic having excellent strength and airtight qualities. Additionally, in one preferred embodiment, the container 50 can include dimensions of approximately 2'×1.5'×1.5° (H×W×D) and the protrusions can be positioned approximately 6" from the bottom surface and extend inward an additional 6". Such dimensions being capable of allowing a single container to hold the 144 ounces of beverage, which is the equivalent to twelve 12 oz cans.

Although described above with regard to specific dimensions, shapes sizes and construction materials, this is for illustrative purposes only, as those of skill in the art will recognize that any number of different embodiments can be produced without undue experimentation.

Although described above with respect to particular locations of the input and output valves on both the container 40 and input/output lines on the filling station 20, this is for illustrative purposes only, as those of skill in the art will recognize that these elements can be positioned along any surface of the container and receiving bay to facilitate usage of the system.

Figure 6:
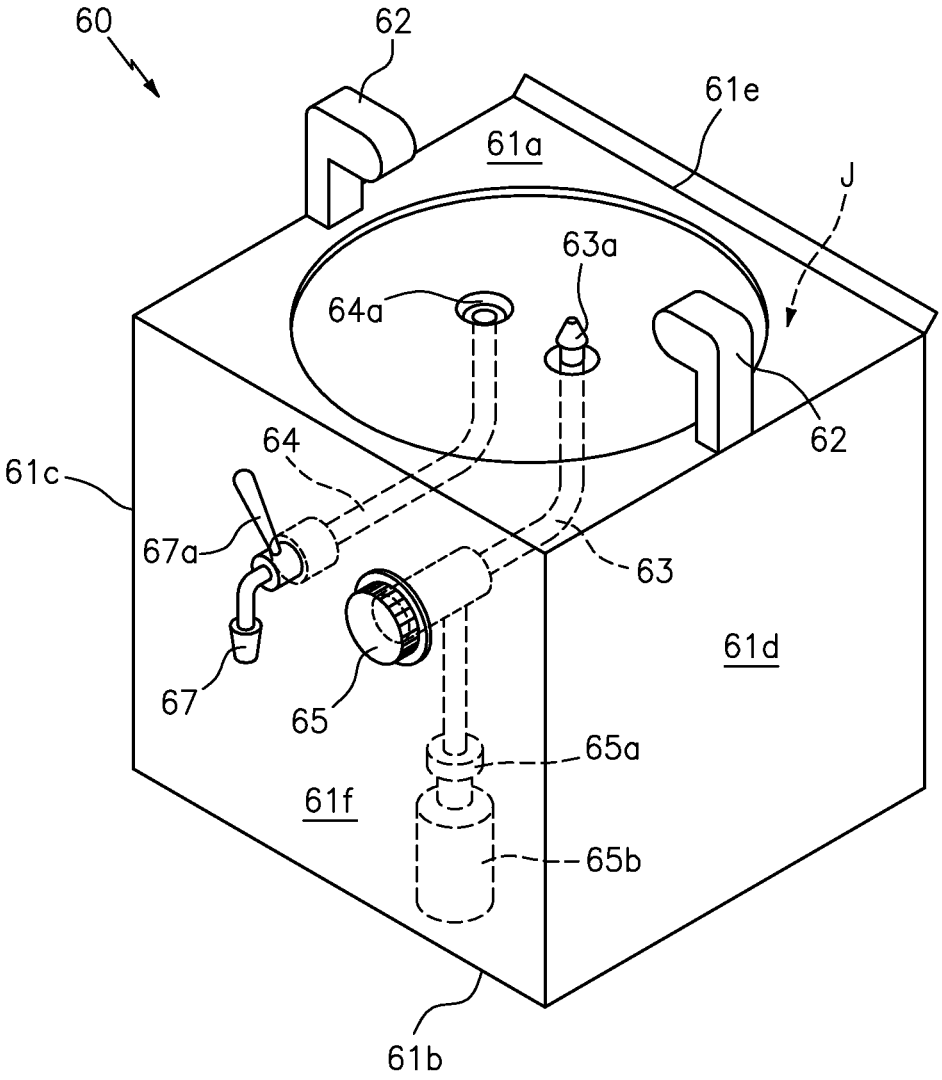
FIG. 6 is a perspective view of a dispensing tap, in accordance with another embodiment of the invention.

FIG. 6 illustrates one embodiment of a dispensing tap 60 for use with the container 50 described above. The dispensing tap 60 can act as a device for providing draft beer on-demand to a user, and can include a main body, a tap line, a co2 supply line, a regulator and a beer tap. In one preferred embodiment, the dispensing tap 60 can be small and portable in nature so as to allow use by a consumer in a plurality of socially and legally acceptable settings.

The main body can include a top surface 61*a*, a bottom surface 61*b* a pair of opposing side surfaces 61*c* and 61*d*, a back surface 61*e*, and a front surface 61*f*, each forming an interior space J. As shown, the back surface 61*e* can preferably include a raised lip that extends above the top surface of the device. Additionally, a pair of raised protrusions 62 can extend upward from the side surfaces 61*c* and 61*d* and radiating inward, so as to engage the indentions 51*d* of the container 50. Such a feature can assist to ensure that the home dispenser will not operate with containers other than the specified container 50.

A C02 supply line 63 and a tap line 64 can be provided so as to work in conjunction with the fill valve 53 and drain valve 54 of the container 50. To this end, the C02 supply line 63 can include a first end having a connector 63*a* located along the top surface of the main body 61*a*, for mating with a complementary connector 53*a* of the container 50. The tap line 64 can also include a first end having a connector 64*a* for mating with a complementary connector 54*a* of the container 50. The C02 supply line 63 acting to supply a pressurized gas 7 (See FIG. 8) into the container, and the tap line 64 acting to remove the stored beverage from the container.

The C02 supply line 63 can include a second end that is in communication with a regulator valve 65 having a connector 65*a* for receiving a canister of compressed gas 65*b*, such as C02, for example. The tap supply line 64 can include a second end that is in communication with a conventional beer tap/valve 67 having a handle 67*a* for dispensing the beverage into a mug or other such drinking glass.

Although described above with regard to a pressurized system, this is for illustrative purposes only, as the system can function in a non-pressurized manner utilizing gravity to feed the beverage down to the tap. In such an embodiment, the C02 supply line can be open to the outside air, so as to allow proper venting of the container contents.

As described herein, complementary connectors 23*a*, 53*a*, and 63*a* can include any number of conventional devices suitable for creating a non-permanent seal between two objects in order to allow a transfer of beverage therebetween. Several suitable examples can include compression fittings, opposing magnetic elements and/or a lip and receiver shape. To this end, it is noted that connectors 53*a* and 63*a* will be identical in nature so as to each interface with connector 23*a*. Likewise, complementary connectors 24*a*, 54*a* and 64*a* can also include any number of conventional devices suitable for creating a non-permanent seal between two objects in order to allow a transfer of beverage therebetween. Several suitable examples can also include compression fittings, opposing magnetic elements and/or a lip and receiver shape. Connectors 54*a* and 64*a* will also be identical in nature so as to each interface with connector 24*a*.

Figure 7:
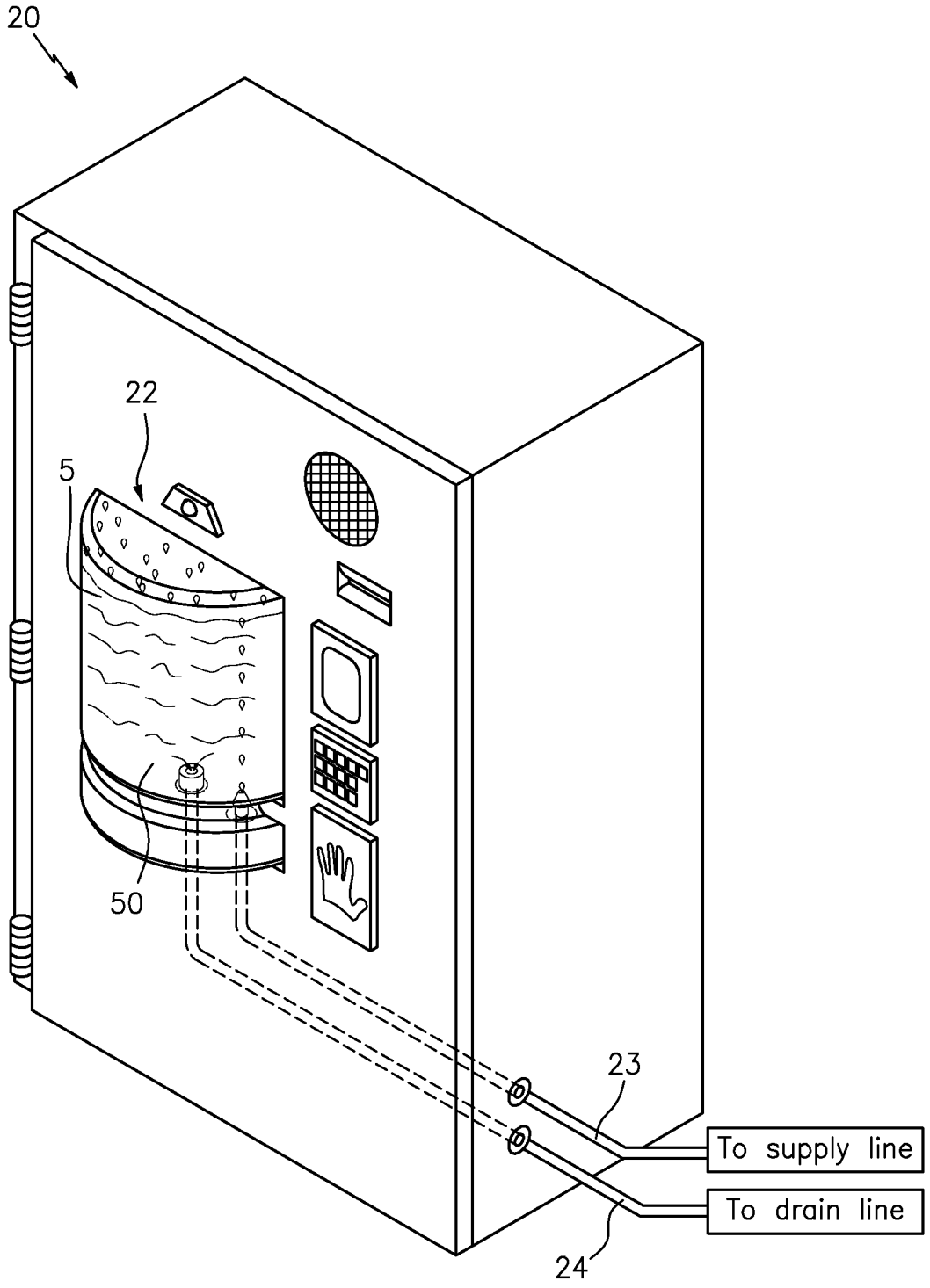
FIG. 7 is a perspective view of the self-service container filling station in operation, in accordance with one embodiment of the invention.
Figure 8:
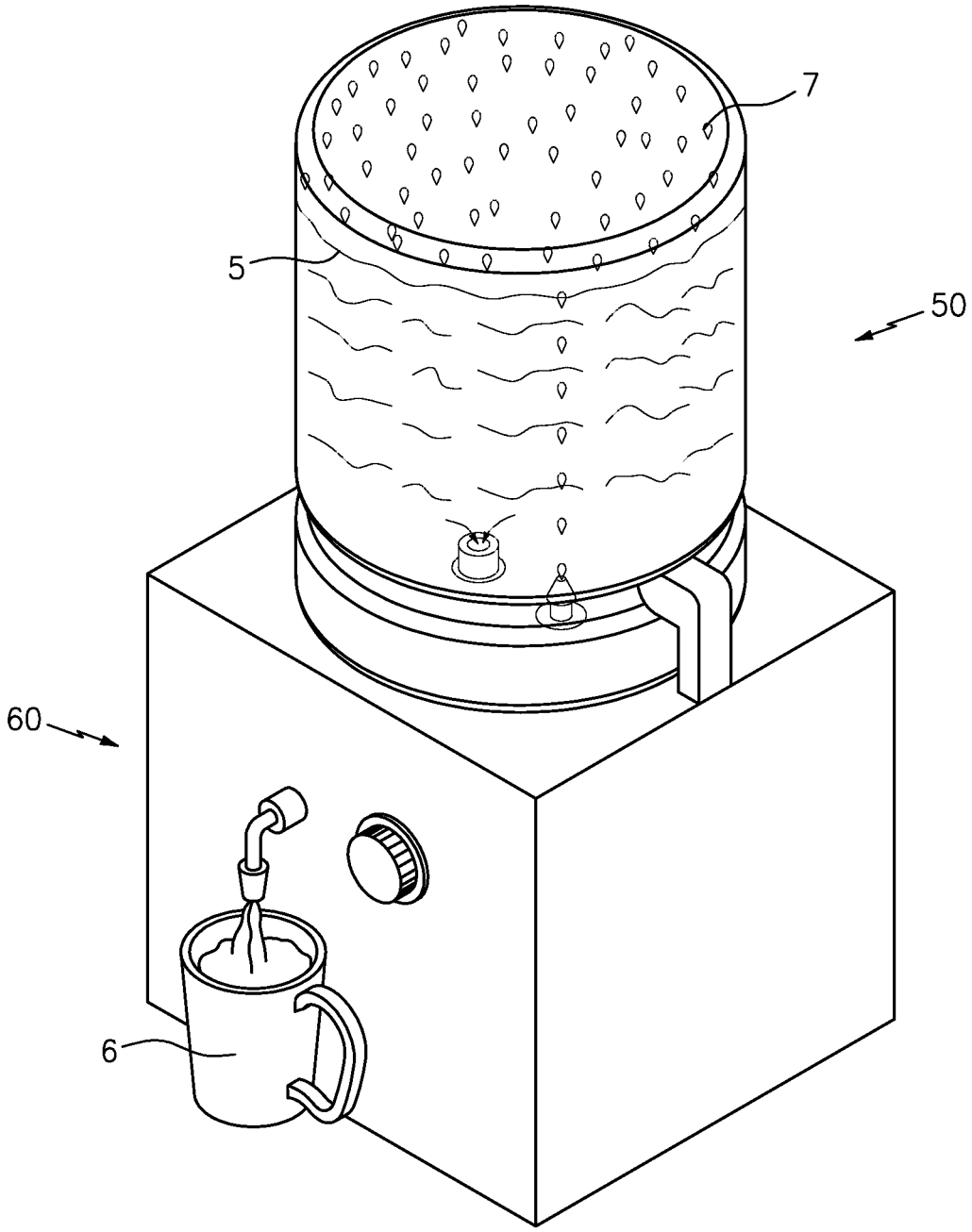
FIG. 8 is a perspective view of the dispensing tap in operation, in accordance with another embodiment of the invention.

FIGS. 7 and 8 illustrate one embodiment of the system 100 in operation utilizing the self service container filling station 20, the reusable container 50 and the dispensing tap 60, described above. To this end, once a consumer has been pre-registered via the system administrator wherein the consumers' age has been verified, they will be provided a reusable container 50. The container can be either bought or rented to the consumer. Upon receipt of the container 50, the consumer can insert the container into the receiving bay 22 of a filling station 20, verify their identity via the biometric scanner, select the type and quantity of beverage to order, pay, and then fill the container the selected beverage 5, as described above, and as shown in FIG. 7. Once the container has been filled, the container can be inserted onto the home tap 60 (See FIG. 8), which can dispense the beverage 5 into a mug 6 for consumption by the user.

As shown in FIG. 8, when the container 50 is slid onto the top surface of the main body 61*a*, the raised protrusions 62 combined with the lip 61*e* act to securely position the container onto the dispenser in a manner that aligns the complementary connectors, and prevents the container from falling off of the dispenser.

As described herein, one or more elements of each of the self service container filling station 20, the removable container 50, and the dispenser 60 can each be secured together utilizing any number of known attachment means such as, for example, screws, glue, compression fittings and welds, among others. Moreover, although the above embodiments have been described as including separate individual elements, sizes, dimensions and construction materials, this is for illustrative purposes only, as many different embodiments can be accomplished without undue experimentation and in the spirit of the inventive concepts disclosed herein.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A self service controlled beverage dispensing system, comprising:

a generally hollow container having a fill valve, a drain valve, a fill valve connector, and a drain valve connector disposed thereon;

a self service filling station that includes a main body having a receiving bay for receiving the container, a beverage fill line having a first connector located within the receiving bay, said first connector being configured to engage the fill valve connector of the container, and said fill line being configured to supply a beverage to the container, a drain line having a second connector located within the receiving bay, said second connector being configured to engage the drain valve connector of the container, and said drain line being configured to remove a foam and air from the container, a biometric identification unit configured to establish an age and identity of a user, a communication unit configured to communicate with a system server via a network, one or more input and output devices configured to interface with a user, and a central control unit configured to control an operation of the self service filling station; and a dispensing tap that includes a main body having a surface for receiving the container, a C02 supply line having a C02 connector that is configured to engage the fill valve connector of the container, and said C02 supply line being configured to supply a pressurized gas to the container, a tap line having a tap connector that is configured to engage the drain valve connector of the container, and said tap line being configured to transport a received beverage to a beer tap valve that is located on the main body of the dispensing tap.

2. The system of claim 1, wherein the central control unit includes a processor configured to control the biometric identification unit, the communication unit, and the one or more input and output devices; and a memory configured to store operating instructions and user permissions.

3. The system of claim 1, wherein the biometric identification system includes, at least one of a fingerprint scanner, a handprint scanner, a retinal scanner and a facial recognition system, that is in communication with the central control unit.

4. The system of claim 1, wherein the beverage fill line is configured to engage an external beverage supply system.

5. The system of claim 1, wherein said input and output unit includes at least one of a keypad, a graphic user interface, and a speaker.

6. The system of claim 1, further comprising:

a payment device configured to receive payment from a user, said payment device being positioned on the main body of the filling station and being in communication with the central control unit.

7. The system of claim 1, wherein the container further includes a pair of oppositely placed indentations, and the receiving bay further includes a pair of oppositely placed protrusions, said indentations and protrusions having complementary shapes and locations and being configured to prevent usage by foreign containers.

8. The system of claim 1, wherein said container includes a dimension suitable for storing 144 ounces of beverage.

9. The system of claim 1, further comprising:

a C02 regulator valve configured to control a flow of C02 within the C02 supply line; and a C02 canister connector.

* * * * *